United States Patent [19]

Makashima

[11] Patent Number: 4,689,159

[45] Date of Patent: Aug. 25, 1987

[54] TEXTILE PROCESSING AGENT AND TREATMENT OF TEXTILE WITH THE SAME

[75] Inventor: Norihiko Makashima, Wakayama, Japan

[73] Assignee: Kao Corporation, Tokyo, Japan

[21] Appl. No.: 730,871

[22] Filed: May 3, 1985

[30] Foreign Application Priority Data

May 14, 1984 [JP] Japan ..... 59-96268

[51] Int. Cl.[4] ..... D06M 13/00

[52] U.S. Cl. ..... 252/8.6

[58] Field of Search ..... 252/8.6; 523/408, 409, 523/412

[56] References Cited

U.S. PATENT DOCUMENTS

| | | | |
|---|---|---|---|
| 2,954,358 | 9/1960 | Hurwitz | 523/409 |
| 4,075,148 | 2/1978 | Zatmann | 523/409 |
| 4,111,819 | 9/1978 | Muijs | 252/8.6 |
| 4,162,984 | 7/1979 | De Block et al. | 252/8.6 |
| 4,169,062 | 9/1979 | Weipert | 252/8.6 |
| 4,247,439 | 1/1981 | Matthews et al. | 523/409 |
| 4,302,373 | 11/1981 | Steinmetz | 428/416 |
| 4,371,517 | 2/1983 | Vanlerberghe et al. | 8/115.7 |
| 4,383,059 | 5/1983 | Brook et al. | 523/412 |
| 4,388,372 | 6/1983 | Champaneria et al. | 523/409 |
| 4,444,923 | 4/1984 | McCarty | 523/409 |
| 4,446,260 | 5/1984 | Woods et al. | 523/409 |
| 4,458,040 | 7/1984 | Suzuki et al. | 523/412 |
| 4,477,514 | 10/1984 | Gee et al. | 252/8.6 |
| 4,501,831 | 2/1985 | Chu et al. | 523/412 |
| 4,520,143 | 5/1985 | Jellinek | 523/410 |
| 4,579,888 | 4/1986 | Kodama et al. | 523/412 |

*Primary Examiner*—Paul Lieberman
*Assistant Examiner*—Willie J. Thompson
*Attorney, Agent, or Firm*—Flynn, Thiel, Boutell & Tanis

[57] ABSTRACT

A textile is treated with a processing composition comprising (1) a water-soluble polymer having carboxyl groups and (2) a crosslinking agent having at least two groups reactive with the carboxyl groups before processing the treated textile with a cationic emulsion.

3 Claims, No Drawings

TEXTILE PROCESSING AGENT AND TREATMENT OF TEXTILE WITH THE SAME

The present invention relates to a textile processing agent and a process for treating a textile with the same. More particularly, the present invention relates to a textile processing agent for use in uniformly processing a textile product with a cationic emulsion and a process for treating a textile product with the same.

Heretofore, a variety of functional emulsions have been used in differentiation of textile products. Usually, textiles are negatively charged in water, so that it is thought that cationic emulsions are adsorbed more easily on textiles and provide uniform processing and they are actually used more frequently. In processing a thick cloth with a cationic emulsion, however, the emulsion particles are forced to move toward the inside by capillarity during dewatering after the processing (centrifugal dewatering or mangle squeezing) and no emulsion particles are allowed to remain on the surface of the cloth. Therefore, no function can be imparted to the surface of the cloth in such a case, thus resulting in incomplete processing. This phenomenon gives rise to a serious problem in differentiation such as shade improving or water-repellent processing. Further, it sometimes happens that other processings are carried out incompletely, though unintentionally.

Essentially, no satisfactory function can be imparted to a textile in processing unless the emulsion particles are uniformly adsorbed on the textile. However, incomplete processing often occurs in conventional textile processing because treatments such as continuous processing, dipping, or spraying are carried out without complete knowledge of the interaction between the textile and the finishing agent. Particularly, it is very difficult to treat a thick cloth so that both its surface and inside are uniformly processed, because of the above-mentioned permeation into the inside. Therefore, although cationic emulsions which can be easily adsorbed on textiles are frequently used, it is not possible to effect uniform processing of a thick cloth.

As a result of extensive studies to solve these problems, the inventors of the present invention have found that it is possible to effect uniform processing of a textile product (even when it is a thick cloth) by treating the product with a textile processing agent comprising a water-soluble polymer having carboxyl groups and a crosslinking agent having at least two functional groups reactive with the carboxyl group prior to processing it with a cationic emulsion, and completed the present invention.

This invention provides a textile processing composition which comprises (1) a water-soluble polymer having carboxyl groups and (2) a crosslinking agent having at least two groups reactive with the carboxyl groups and then a method for treating a textile which comprises the steps of treating a textile with a textile processing composition comprising (1) a water-soluble polymer having carboxyl groups and (2) a crosslinking agent having at least two groups reactive with the carboxyl groups and then processing the treated textile with a cationic emulsion.

The water-soluble polymers having carboxyl groups relevant to the present invention include any of naturally occurring and synthetic polycarboxylic acids. Examples of the naturally occurring polycarboxylic acids include acidic polysaccharides such as pectic acid or its salts, and alginic acid and its salts. Examples of the synthetic polycarboxylic acids include polyacrylic acid, polymaleic acid, polymethacrylic acid, vinyl acetate/maleic acid copolymers, vinyl acetate/acrylic acid copolymers, polyvinyl alcohol/maleic acid copolymers, acrylate/acrylic acid copolymers, acrylic acid/maleic acid copolymers, and water-soluble salts thereof (including their partial salts). It is of course possible to apply water-soluble polymers containing carboxyl groups, other than the above-mentioned.

Examples of the crosslinking agents having at least two carboxyl groups which can be used in the present invention include polyglycidyl ethers such as ethylene glycol diglycidyl ether, a polyethylene glycol diglycidyl ether, and glycerin triglycidyl ether; epoxy compounds ssuch as haloepoxy compounds such as epichlorohydrin and $\alpha$-methylchlorohydrin; polyaldehydes such as glutaraldehyde and glyoxal; polyols such as glycerin, pentaerythritol, and ethylene glycol; and polyamines such as ethylenediamine, among which the epoxy compounds are desirable. It is of course possible to use crosslinking agents other than the above-mentioned.

Although the ratio of the water-soluble polymer having carboxyl groups to the crosslinking agent varies with the kind, etc., of the polymer or of the crosslinking agent, it is usually 1/0.001 to 1/30, preferably 1/0.01 to 10 by weight.

A textile product can be treated with the textile processing agent of the present invention by any desired method such as one in which a textile product is dipped in a solution of 0.01 to 10 wt. % of the processing agent, one comprising dip-nip treatment, and one in which a textile product is sprayed with the solution. It is preferable that the textile product is heat-treated after the treatment under a condition suited for each fiber material, fiber form, dyeing state, etc.

By effecting the above treatment with the processing agent of the present invention, the water-soluble polymer is crosslinked with the crosslinking agent and fixed on the surface of the textile in the form of a crosslinked polymer.

The textile processing agent is attached to a textile product in an amount of 0.01 to 10 wt. %, preferably 0.05 to 5 wt.% in terms of solids.

The textile processing agent of the invention can be applied to any fibers, that is, natural cellulose fibers such as cotton and linen, regenerated cellulose fibers such as viscose rayon and cuprammonium rayon, natural animal fibers such as wool and silk, synthetic fibers such as polyester, acrylics and polyamide (nylon) and semisynthetic fibers such as acetate. Although the processing agent can be applied to any form of fiber, such as staple, tow, cheese cloth, etc., it can exhibit its effect of pretreatment most markedly especially upon a thick cloth.

When a textile product which has been treated with the textile processing agent of the present invention is processed with a cationic emulsion, it is possible to effect uniform processing even when the textile product is a thick cloth. For example, when a dyed cloth pretreated with the textile processing agent of the instant invention is processed with a shade-improver (a cationic emulsion) disclosed in Japanese patent publication A No. 29682/82 and Japanese patent publication A No. 139885/82, a remarkably excellent color-deepening effct can be obtained.

Thus, it is another object of the present invention to provide a process for treating a textile, characterized by treating a textile product with a textile processing agent comprising a water-soluble polymer having carboxyl groups and a crosslinking agent having functional groups reactive with the carboxyl group and processing the resulting product with a cationic emulsion.

The cationic emulsions relevant to the present invention are not particularly limited. Exemplary of the emulsions are color-deepening agents (cationic emulsions) described in Japanese Patent Laid-Open No. 29682/1982 and Japanese Patent Publication No. 139885/1982. In addition, there can be mentioned water repelling agents, antistatic agents, water and sweat-absorptive processing agents, hand builders, and a variety of resin processing agents.

The conditions for processing with a cationic emulsion are not particularly limited. It can be freely selected according to the emulsion used.

Although the mechanism by which uniform processing can be attained in the process of the present invention is not entirely understood, it might be considered that introduction of carboxyl groups into the textile serves to increase the interaction between the textile and the cationic emulsion and make uniform processing possible. However, details of the mechanism are not clear as yet.

In any case, it has become possible to attach a cationic emulsion uniformly also to a thick cloth by the process of the present invention.

It is not critical whether the cloth to be pretreated with the processing agent of the present invention is an undyed cloth or a dyed cloth. That is to say, any of the following processes can be used:

1 dyed cloth→pretreatment→aftertreatment, and 2 undyed cloth→pretreatment→aftertreatment→dyeing. The dyeing can be performed by any type of dipping, textile printing, and continuous dyeing.

Concerning the aftertreatment, the function of the surface of a cloth is important.

Although the effect of the pretreatment with the processing agent of the present invention is marked especially when the processing is performed with a color-deepening agent, a water-repelling agent or the like, complete and uniform processing becomes possible by carrying out the pretreatment with the processing agent of the present invention even in the case of processes other than those mentioned above.

The present invention will now be described in detail with reference to examples, but the present invention is by no means limited thereto.

EXAMPLE 1

Polycarboxylic acids shown in Table 1 were synthesized according to a usual manner.

TABLE 1

| | Polycarboxylic acid | Molecular weight |
|---|---|---|
| Synthesis Example 1 | polyacrylic acid | 3,000 |
| Synthesis Example 2 | acrylic acid/maleic acid copolymer | 3,000 |
| Synthesis Example 3 | polymaleic acid | 5,000 |

A polyester cloth was treated with a textile processing agent comprising a polycarboxylic acid shown in Table 1 and a crosslinking agent (Denacol EX-313, a product of Nagase & Co. Ltd., glycerol polyglycidyl ether), and the ζ potential of the cloth was measured. The results are shown in Table 2.

[Condition of treatment]

A bath containing 5 g/l of a polycarboxylic acid and 0.5 g/l of the crosslinking agent was prepared, and a polyester cloth was padded with the bath, squeezed to 100% owf, and dried at 100° C. for 5 minutes. It was cured at 150° C. for 3 minutes.

[Condition of ζ potential measurement]

The measurement was made by using a device for measuring a streaming potential, a product of Shimadzu Seisakusho Ltd. A 0.001N KCl solution (pH 7) was used as a streaming solution.

TABLE 2

| | Polycarboxylic acid | Crosslinking agent | ζ-potential |
|---|---|---|---|
| Examples of this Invention | Synthesis Example 1 | Denacol EX-313 | −43 mV |
| | Synthesis Example 2 | " | −40 mV |
| | Synthesis Example 3 | " | −38 mV |
| | — | — | −20 mV |

Table 2 shows that when cloths are treated with the textile processing agents of the present invention, the treated cloths show markedly increased ζ potentials.

EXAMPLE 2

A black cloth was obtained by dyeing a thick polyester cloth (basis weight of 500 g/m$^2$) as deeply as possible. The dyed cloth was pretreated in the same manner as in Example 1, and then treated with a color-deepening agent TR-420, a cationic agent available from Kao Corporation, and the shade-improving effect on the treated cloth was measured. Results are shown in Table 3.

[Condition of processing with a color-deepening agent]

A bath containing 40 g/l of TR-420 was prepared, and a dyed, pretreated cloth was padded with the bath, squeezed to 100% owf, dried at 100° C. for 5 minutes, and further cured at 150° C. for 3 minutes.

TABLE 3

| | Pretreating agent | | Aftertreating agent | Color-deepening effect (L value)*2 | |
|---|---|---|---|---|---|
| | Polycarboxylic acid | Crosslinking agent | Color-deepening agent | Just after processing | After washing five times |
| Examples of this invention | Synthesis Example 1 | Denacol EX-821*1 | TR-420 | 13.2 | 13.2 |
| | Synthesis Example 2 | " | " | 13.4 | 13.5 |
| | Synthesis Example 3 | " | " | 13.3 | 13.3 |
| Comparative | — | — | " | 14.5 | 14.6 |

TABLE 3-continued

| | Pretreating agent | | Aftertreating agent | Color-deepening effect (L value)*2 | |
|---|---|---|---|---|---|
| | Polycarboxylic acid | Crosslinking agent | Color-deepening agent | Just after processing | After washing five times |
| Examples | — | — | — | 15.0 | 15.0 |

*1polyethylene glycol diglycidyl ether, a product of Nagase & Co., Ltd.
*2measured with a color computer, a product of Suga Test Instruments Co., Ltd. The smaller the L value, the higher the color deepening effect.

Table 3 shows that when cloths are pretreated with the textile processing agents of the present invention, they exhibit an excellent color-deepening effect and their durability is excellent.

EXAMPLE 3

Cloths were treated with textile processing agents under the following conditions of dipping and were then processed with a color-deepening agent TR-420. The color deepening effect of the processed cloths were measured. The results are shown in Table 4.

[Condition of dipping]

A bath containing 1 g/l of a polycarboxylic acid and 0.1 g/l of a crosslinking agent was prepared. A black polyester cloth was placed in the bath, treated at 60° C. for 30 minutes, dewatered, and dried.

[Condition of color-deepening]

pad-dry-cure process
similar to that in Example 2

TABLE 4

| | Textile processing agent | | | Color-deepening effect (L value) | |
|---|---|---|---|---|---|
| | Polycarboxylic acid | Crosslinking agent | Color-deepening agent | Just after processing | After washing five times |
| Examples of this invention | Synthesis Example 1 | Denacol EX-851 | TR-420 | 13.5 | 13.5 |
| | Synthesis Example 2 | " | " | 13.6 | 13.7 |
| | Synthesis Example 3 | " | " | 13.6 | 13.6 |
| Comparative Examples | — | — | " | 14.5 | 14.6 |
| | — | — | — | 15.0 | 15.0 |

EXAMPLE 4

Thick cloths of polyester, nylon, and cotton were each treated with a textile processing agent and then processed with a cationic water-repellent. The water repellencies of the processed cloths were measured. The results are shown in Table 5.

[Condition of treatment with a textile processing agent]

pad-dry-cure process
treating solution:
5 g/l of a polycarboxylic acid and
1 g/l of a crosslinking agent

[Condition of processing with a cationic water-repellent]

pad-dry-cure process
processing solution; 20 g/l of a commercially available product A

TABLE 5

| | Pretreating agent | | Aftertreating agent | Water repellency*2 | | |
|---|---|---|---|---|---|---|
| | Polycarboxylic acid | Crosslinking agent | Water-repelling agent | Polyester | Nylon | Cotton |
| Examples of this invention | Synthesis Example 1 | Donacol EX-313 | Commercially available product A*1 | 100 | 100 | 100 |
| | Synthesis Example 2 | " | Commercially available product A*1 | 100 | 100 | 100 |
| | Synthesis Example 3 | " | Commercially available product A*1 | 100 | 100 | 100 |
| Comparative Examples | — | — | Commercially available product A*1 | 70–80 | 80 | 80 |
| | — | — | — | 70 | 50 | 0 |

*1fluorine-containing cationic water-repelling agent
*2water-repellent test method: according to JIS L1004.

Table 4 shows that when textiles are pretreated, all of them can show an excellent repellency to water. On the contrary, the water repellency is poor when textiles are processed with a water-repellent only.

The embodiments of the invention in which an exclusive property or privilege is claimed are defined as follows:

1. A method for treating a textile which comprises impregnating the textile with from 0.01 to 10 wt.%, calculated as the solids, of a textile processing composition consisting essentially of an aqueous composition containing:

(1) a water-soluble polymer having carboxyl groups, or water-soluble salt thereof, wherein said polymer contains monomer units selected from the group consisting of acrylic acid and maleic acid and (2) an epoxide cross-linking agent having at least two groups reactive with said carboxyl groups of said water-soluble polymer to cross-link said polymer; the weight ratio of said water-soluble polymer (1) to said cross-linking agent (2) being in the range of 1/0.01 to 1/10, curing said composition to crosslink said polymer, and then treating the textile with a cationic emulsion for treating textiles.

2. A method as claimed in claim 1 in which the textile is impregnated with from 0.05 to 5.0 wt. % of said textile processing composition, calculated as solids.

3. A method for treating a textile which comprises impregnating the textile with from 0.01 to 10 wt.%, calculated as the solids, of a textile processing composition consisting of an aqueous solution of a water-soluble polymer having carboxyl groups, said polymer being selected from the group consisting of polyacrylic acid, polymaleic acid and acrylic acid/maleic acid copolymers, and a cross-linking agent reactive with said carboxyl groups of said water-soluble polymer to cross-link said polymer, said cross-linking agents being selected from the group consisting of ethylene glycol diglycidyl ether, polyethylene glycol diglycidyl ether, glycerine triglycidyl ether, epichlorohydrin and α-methyl chlorohydrin, drying and then heat treating the impregnated textile to crosslike said polymer, and then treating the textile with a cationic emulsion for treating textiles, said cationic emulsion being selected from the group consisting of color-deepening cationic emulsions, water-repelling cationic emulsions and anti-static cationic emulsions.

* * * * *